US009130293B2

(12) United States Patent
Yu et al.

(10) Patent No.: US 9,130,293 B2
(45) Date of Patent: Sep. 8, 2015

(54) ELECTRICAL CONNECTOR WITH IMPROVED CONTACT STRUCTURE

(71) Applicant: ALLTOP ELECTRONICS (SUZHOU), LTD., Taicang, JiangSu (CN)

(72) Inventors: Wang-I Yu, Jhonghe (TW); Ya-Juan Gou, Jhonghe (TW); Chih-Che Chen, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 25 days.

(21) Appl. No.: 14/021,635

(22) Filed: Sep. 9, 2013

(65) Prior Publication Data

US 2014/0377967 A1 Dec. 25, 2014

(30) Foreign Application Priority Data

Jun. 25, 2013 (CN) ..... 2013 1 0355549

(51) Int. Cl.

| | |
|---|---|
| ***H01R 13/10*** | (2006.01) |
| ***H01R 13/41*** | (2006.01) |
| *H01R 12/72* | (2011.01) |

(52) U.S. Cl.

CPC ..... *H01R 13/41* (2013.01); *H01R 12/724* (2013.01)

(58) Field of Classification Search

CPC ..... H01R 23/725; H01R 23/7073
USPC ..... 439/682, 78, 79, 660, 507, 825, 907, 439/947

See application file for complete search history.

(56) References Cited

U.S. PATENT DOCUMENTS

| | | | | |
|---|---|---|---|---|
| 7,976,317 | B2 * | 7/2011 | Patel et al. | 439/79 |
| 2009/0088028 | A1 * | 4/2009 | Ngo et al. | 439/682 |
| 2009/0142953 | A1 * | 6/2009 | Patel et al. | 439/345 |
| 2010/0041266 | A1 * | 2/2010 | Data et al. | 439/358 |

* cited by examiner

*Primary Examiner* — Phuongchi T Nguyen
(74) *Attorney, Agent, or Firm* — Sughrue Mion, PLLC

(57) ABSTRACT

An electrical connector includes an insulative housing and a number of conductive contacts received in the insulative housing. Each conductive contact is substantially located in a main surface and includes a contacting portion extending beyond the front wall of the insulative housing, an intermediate portion extending rearward from the contacting portion and received in the insulative housing, and a termination portion bending vertically from the intermediate portion. The intermediate portion is torn to form at least an interfering means which extending away from the main surface to interferentially engage with the insulative housing for retaining the conductive contact in the insulative housing reliably.

8 Claims, 6 Drawing Sheets

ELECTRICAL CONNECTOR WITH IMPROVED CONTACT STRUCTURE

BACKGROUND OF THE INVENTION

1. Field of the Invention

The present invention relates to an electrical connector, more particularly to an electrical connector mounted on a Printed Circuit Board (PCB).

2. Description of Related Art

With the rapid development of the electronic technology, electrical connectors are widely used in electronic products for exchanging information or data etc. with peripheral devices. An electrical connector usually comprises an insulative housing, and a plurality of contacts accommodated in the insulative housing. The insulative housing usually defines a plurality of contact-receiving slots for accommodating the contacts. The contact is disposed with a plurality of barbs for interferentially engaging with the contact-receiving slot, thus, the contact could be retained in the insulative housing reliably.

However, the barb structures of the contacts of the conventional electrical connector is usually located on the same surface as the contact body, which is easy to be assembled to the contact-receiving slots of the insulative housing, but the interference effect is not desirable. Thus, the contacts are prone to rotating in the contact-receiving slots and becoming deflected, further the solder becomes difficult and electrical connection between the electrical connector and a complementary connector is not stable.

Hence, it is necessary to improve the conventional electrical connector to address problems mentioned above.

BRIEF SUMMARY OF THE INVENTION

Accordingly, an object of the present invention is to provide an electrical connector which is easy to be assembled and has high reliability.

In order to achieve the above-mentioned object, an electrical connector in accordance with the present invention comprises an insulative housing and a plurality of conductive contacts received in the insulative housing. The insulative housing comprises a front wall, a rear wall opposite to the front wall, a top wall, a bottom wall opposite to the top wall and a pair of sidewalls connecting with the opposite front wall and rear wall, and opposite top wall and bottom wall. The insulative housing defines a plurality of contact-receiving slots penetrating the front wall to the rear wall. Each conductive contact is substantially located in a main surface and respectively received in the contact-receiving slot of the insulative housing. Each conductive contact comprises a contacting portion extending beyond the front wall of the insulative housing, an intermediate portion extending rearward from the contacting portion and received in the contact-receiving slot, and a termination portion bending vertically from the intermediate portion. The intermediate portion is torn to form at least an interfering means extending away from the main surface to interferentially engage with the contact-receiving slot for retaining the conductive contact in the insulative housing reliably.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
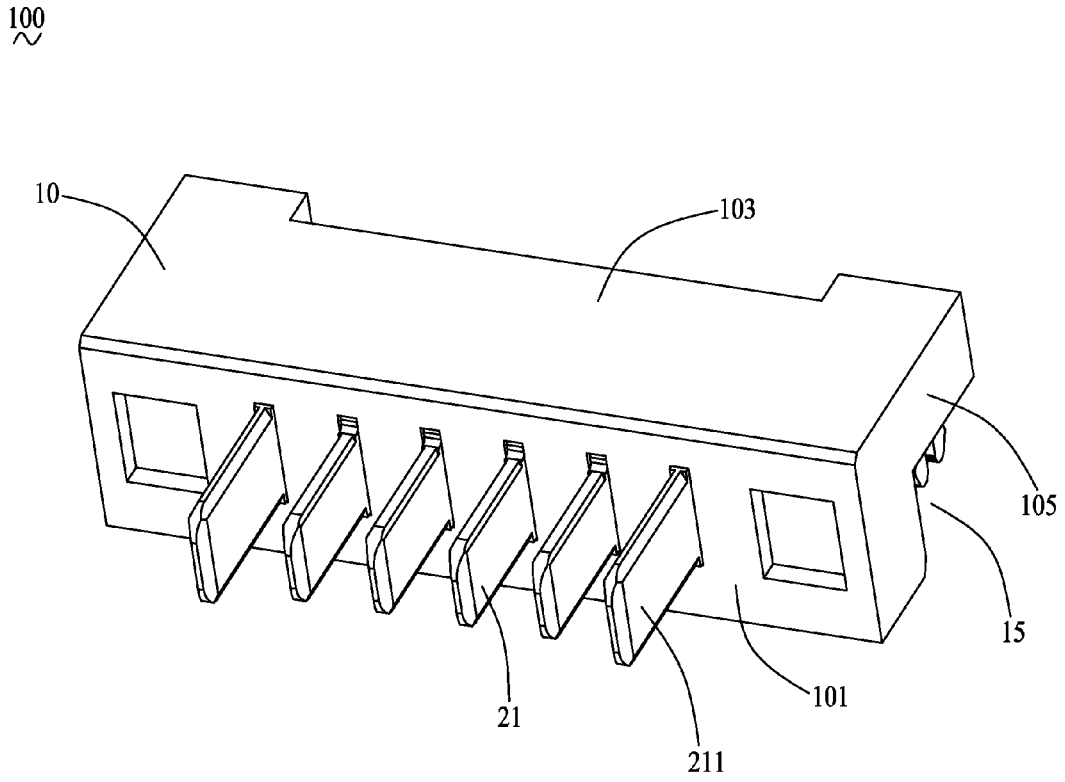
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
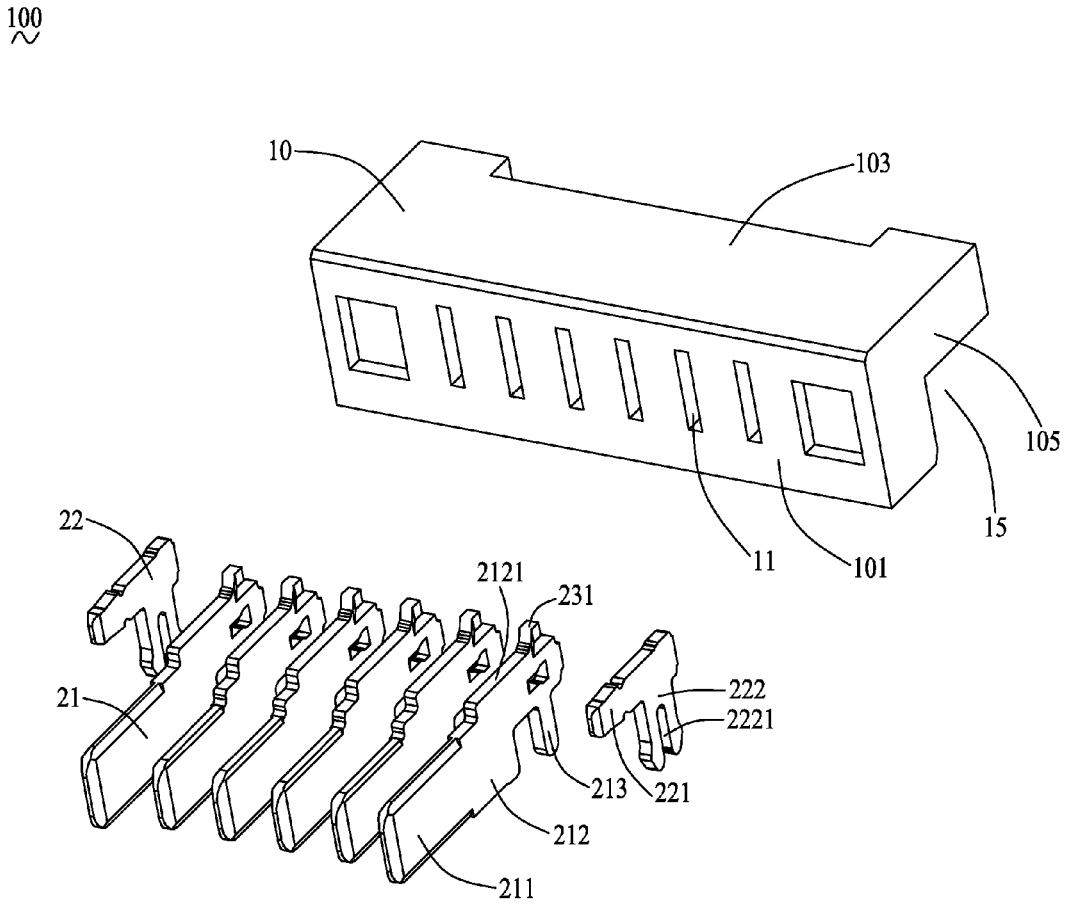
FIG. 2 is an exploded, perspective view of the electrical connector shown in FIG. 1.

Please refer to FIGS. 1-2, an electrical connector 100 in accordance with the present invention is used to be assembled to a Printed Circuit Board (PCB). The electrical connector 100 comprises an insulative housing 10, and a plurality of conductive contacts 21 assembled in the insulative housing 10.

Figure 3:
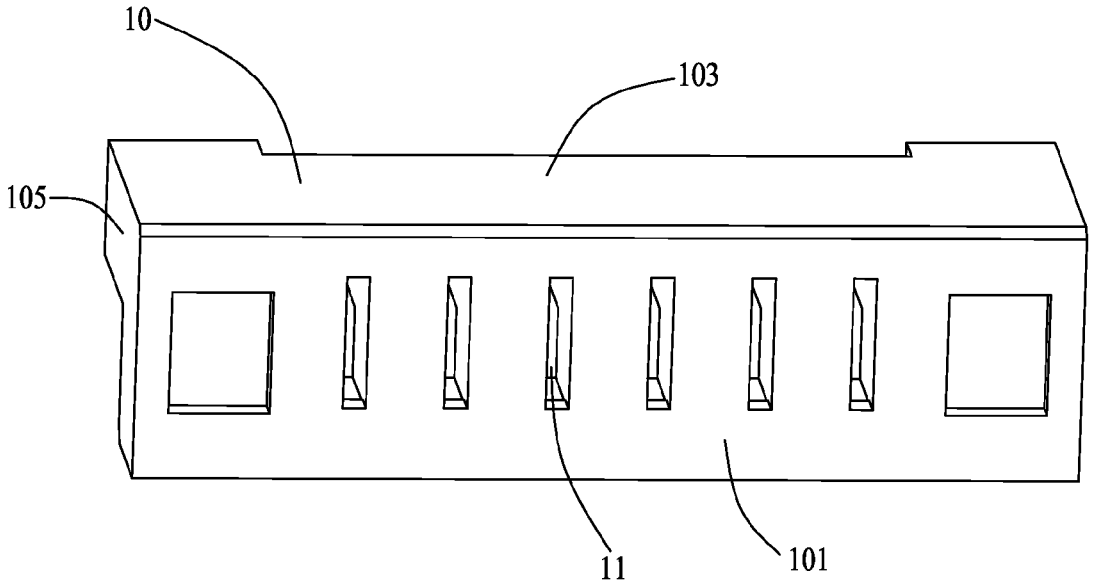
FIG. 3 is a perspective view of an insulative housing shown in FIG. 2.
Figure 4:
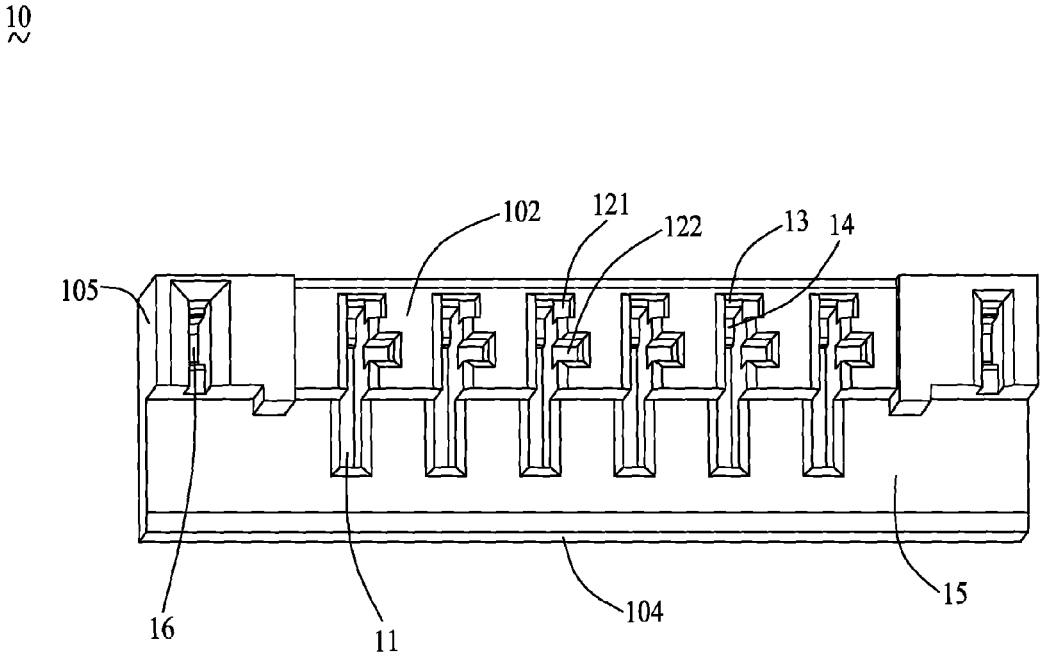
FIG. 4 is a view similar to FIG. 3, but from a different aspect.

Please refer to FIGS. 3-4, the insulative housing 10 comprises a front wall 101, a rear wall 102 opposite to the front wall 101, a top wall 103, a bottom wall 104 opposite to the top wall 103, and a pair of sidewall 105 connecting with the opposite front and rear walls 101, 102, and opposite top and bottom walls 103, 104. A lower section of the rear wall 102 is cut to form a cutout 15 which makes the cross-section of the rear wall 102 L-shaped.

The insulative housing 10 defines a plurality of contact-receiving slots 11 extending from the real wall 102 till the front wall 101 to communicate with the cutout 15. In an upper section of the rear wall 102, each contact-receiving slot 11 communicates with a first interference channel 121 and a second interference channel 122. Both the first interference channel 121 and the second interference channel 122 are recessed forwardly toward the front wall 101 and transversely toward the right sidewall 105 a certain distance from a right side of the contact-receiving slot 11. The first and second interference channels 121, 122 are parallel to each other and arranged in an up-to-down direction. The length along the transverse direction of the second interference channel 122 is longer than that of the first interference channel 121. A retaining slot 13 in the contact-receiving slot 11 is recessed upwardly and forwardly from an upper inner wall of the contact-receiving slot 11 and communicates with the first interference channel 121. A block 14 is formed in the contact-receiving slot 11 adjacent to the retaining slot 13 and extends from the top wall 103 toward the bottom wall 104 a certain distance. A pair of transversely spaced receiving passages 16 is defined in the upper section of the rear wall 102 and extends forwardly toward the front wall 101. The pair of receiving passages 16 communicates with the cutout 15.

In FIG. 2, the conductive contacts 21 are respectively received in the contact-receiving slots 11, while the pair of fastening elements 22 are retained in the receiving passages 16 respectively for retaining the electrical connector 100 to the PCB.

Figure 5:
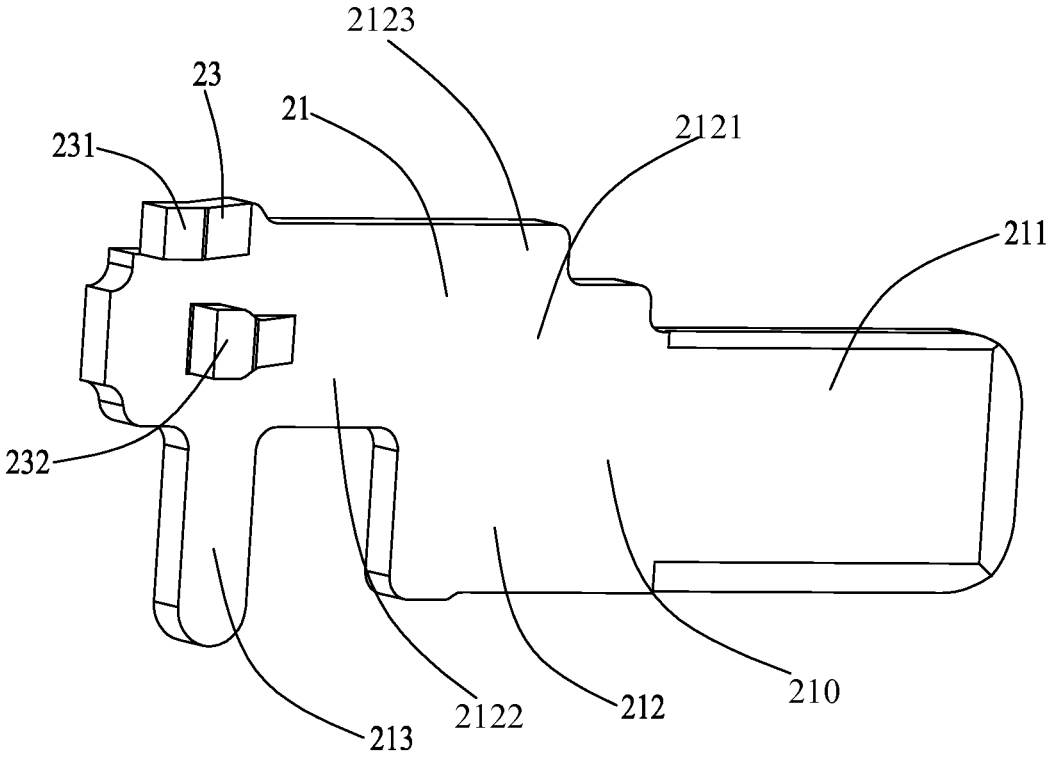
FIG. 5 is a perspective view of a conductive contact shown in FIG. 2.

Please refer to FIG. 5 in conjunction with FIGS. 2-4, each conductive contact 21 is substantially located in a main surface 210 which is an upright surface in the preferred embodiment of the present invention. Each conductive contact 21 comprises a flat contacting portion 211 extending beyond the front wall 101 of the insulative housing 10, an intermediate portion 212 extending rearward from the contacting portion 211 and interferentially received in the contact-receiving slot 11, and a termination portion 213 bending downwardly from a lower edge of the intermediate portion 212. The intermediate portion 212 is of L-shape and comprises a main section 2121 having a height higher than that of the contacting portion 211, and a stretch section 2122 extending rearward from a rear upper section of the main section 2121. The termination portion 213 extends downward from a middle of a bottom edge of the stretch section 2122. An uppermost edge of the intermediate portion 212 is served as a block edge 2123 for being blocked by the block 14 to restrict the movement in front-to-back direction of the conductive contact 21 in the insulative housing 10. The block edge 2123 of the intermediate portion 212 is higher than an upper edge of the contacting portion 211. An upper first interfering section 231 is torn to be formed on an upper edge of the stretch section 2122 and extending along a direction away from the main surface 210 and away from the contacting portion 211. A top edge of the upper first interfering section 231 is higher than the block edge 2123. A lower second interfering section 232 is torn to be formed in a middle section of the stretch section 2122 extending along a direction away from the main surface 210 and away from the contacting portion 211. The first and second interfering sections 231, 232 form the interfering means 23 of the conductive contact 21, and both located on the same side of the stretch section 2122, or the main surface 210. The first interfering section 231 is located above the second interfering section 232.

The first interfering section 231 is interferentially received in the retaining slot 13 and the first interference channel 121, and the second interfering section 232 is interferentially received in the second interference channel 122. Thus, via the engagement between the first interfering section 231 with the first interference channel 121, and the engagement between the second interfering section 232 with the second interference channel 122, the conductive contacts 21 could be retained in the insulative housing 10 stably and reliably.

Each termination portion 213 is exposed in the cutout 15 and the contact-receiving slots 11, for being soldered to the PCB.

Figure 6:
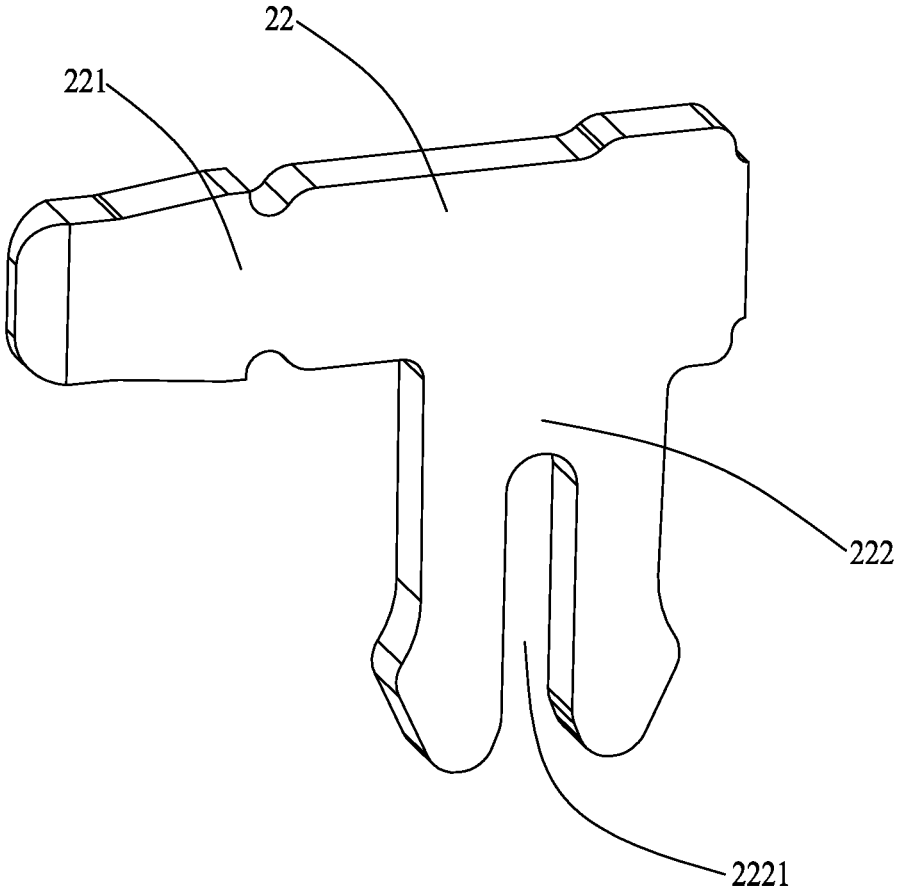
FIG. 6 is a perspective view of a fastening element shown in FIG. 2.

Please refer to FIG. 6, in conjunction with FIGS. 2-3, the fastening element 22 comprises a horizontal base section 221 received in the receiving passage 16, and a solder section 222 extending downward from a bottom edge of the base section 221. The solder section 222 is slotted with a slit 2221 which divides the solder section 222 into two sections and of fork-shape. The solder sections 222 is received in the cutout 15 and the receiving passage 16 for being soldered with the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing comprising a front wall, a rear wall opposite to the front wall, a top wall, a bottom wall opposite to the top wall and a pair of sidewalls connecting with the opposite front wall and rear wall, and opposite top wall and bottom wall, the insulative housing defining a plurality of contact-receiving slots penetrating the front wall to the rear wall;

a plurality of conductive contacts respectively received in the contact-receiving slots of the insulative housing, each conductive contact being substantially located in a main surface and comprising a contacting portion extending beyond the front wall of the insulative housing, an intermediate portion extending rearward from the contacting portion and received in the contact-receiving slot, and a termination portion bending vertically from the intermediate portion; the intermediate portion being torn to form at least an interfering means which extends away from the main surface to interferentially engage with the contact-receiving slot for retaining the conductive contact in the insulative housing reliably;

wherein the interfering means comprises a first interfering section and a second interfering section arranged along an up-to-down direction of the intermediate portion of the conductive contacts;

wherein the insulative housing defines a plurality of first interference channels and a plurality of second interference channels recessed toward the front wall from the rear wall, each pair of first and second interference channels are arranged along the up-to-down direction and communicate with the same contact-receiving slot, and wherein the first and second interfering sections of the conductive contact respectively interferentially engage with the first and second interference channels;

wherein the first and second interference channels both extend perpendicularly to the contact-receiving slot and located at the same side of the contact-receiving slot;

wherein each contact-receiving slot defines a retaining slot recessed upwardly toward the top wall from an upper inner wall thereof, and wherein the first interfering section of each conductive contact is received in both the retaining slot and the first interference channel; and wherein the contact-receiving slot forms a block therein to block an uppermost edge of the intermediate portion of the conductive contact to restrict the movement in a front-to-back direction of the conductive contact;

wherein the length along a transverse direction of the second interference channel is longer than that of the first interference channel; and wherein the rear wall of the insulative housing is partially cut to form a cutout which communicates with the contact-receiving slots, and wherein the termination portions of the conductive contacts are exposed into the cutout.

2. The electrical connector as claimed in claim 1, wherein the uppermost edge of the intermediate portion of the conductive contact is served as a block edge which is higher than an upper edge of the contacting portion.

3. The electrical connector as claimed in claim 1, wherein the cross-section of the insulative housing is of L-shape.

4. The electrical connector as claimed in claim 1, further comprising a pair of fastening elements adapted for retain the electrical connector to a Printed Circuit Board, and wherein the insulative housing defines a pair of transversely spaced receiving passages to interferentially receive the fastening elements.

5. The electrical connector as claimed in claim 1, wherein the first and second interfering sections of each conductive contact are torn to extend away from the main surface of the conductive contact, and away from the contacting portion at the same time.

6. The electrical connector as claimed in claim 5, wherein the first and second interfering sections of the conductive contact are located on the same side of the main surface of the conductive contact, and wherein the first interfering section is longer than the second interfering section.

7. The electrical connector as claimed in claim 1, wherein the intermediate portion of the conductive contact is of L-shape, and comprises a main section connecting with the contacting portion, and a stretch section extending rearward from the main section with reduced height, and wherein the first and second interfering sections are torn to be formed on the stretch section.

8. The electrical connector as claimed in claim 7, wherein the stretch section of the conductive contact comprises an upper edge which is partially torn to form the first interfering section, and a middle section which is partially torn to form the second interfering section.

* * * * *